US007395620B1

(12) United States Patent
McNeely et al.

(10) Patent No.: US 7,395,620 B1
(45) Date of Patent: Jul. 8, 2008

(54) IRONING BOARD ASSEMBLY

(75) Inventors: Noah McNeely, Suwanee, GA (US); Nathan Pascarella, Buford, GA (US); Michael Carlson, Atlanta, GA (US)

(73) Assignee: The Evercare Company, Alpharetta, GA (US)

( * ) Notice: Subject to any disclaimer, the term of this patent is extended or adjusted under 35 U.S.C. 154(b) by 111 days.

(21) Appl. No.: 11/626,983

(22) Filed: Jan. 25, 2007

(51) Int. Cl.
*D06F 81/06* (2006.01)
*A47B 5/06* (2006.01)

(52) U.S. Cl. ..... 38/137; 108/48

(58) Field of Classification Search ..... 38/106, 38/137, 139; 108/47, 48, 42; 312/242
See application file for complete search history.

(56) References Cited

U.S. PATENT DOCUMENTS 1,027,479 A 5/1912 Hoffine
1,063,685 A 6/1913 Hoffine
2,854,148 A 9/1958 Mattos et al.
4,313,385 A * 2/1982 Fitzgerald ..... 108/38
4,779,539 A * 10/1988 Stiglich ..... 108/48
4,976,205 A * 12/1990 Miller et al. ..... 108/47
4,995,681 A * 2/1991 Parnell ..... 312/242
5,170,719 A * 12/1992 Pestone ..... 108/48
5,329,860 A * 7/1994 Mattesky ..... 108/48
5,570,642 A * 11/1996 Lehrman ..... 108/47
5,979,336 A * 11/1999 Nottingham et al. ..... 108/42
6,026,601 A * 2/2000 Kiel ..... 38/137
7,131,222 B1 * 11/2006 Glenn ..... 38/106

* cited by examiner

*Primary Examiner*—Ismael Izaguirre
(74) *Attorney, Agent, or Firm*—Gifford, Krass, Sprinkle, Anderson & Citkowski, PC

(57) ABSTRACT

An ironing board assembly for use with a door. The assembly includes an elongated ironing board and an ironing board support. An upper end of the ironing board support is attached to the top of the door so that the ironing board support extends along and closely adjacent one side of the door. One end of the ironing board is attachable to a lower end of the ironing board support so that the ironing board is movable between a first position in which the ironing board extends horizontally outwardly from the door and a second position in which the ironing board extends vertically and closely adjacent the side of the door and so that a top of the ironing board faces outwardly from the door. A first latch locks the ironing board in its first position while, similarly, a second latch locks the ironing board in its second position.

20 Claims, 7 Drawing Sheets

IRONING BOARD ASSEMBLY

BACKGROUND OF THE INVENTION

I. Field of the Invention

The present invention relates generally to an ironing board assembly which is mountable to a door.

II. Descriptive of Material Art

Ironing boards have long been used for ironing clothes. While many of the previously known ironing boards are self supporting, a number of the previously known ironing boards are mounted to one side of a door. These door mounted ironing boards, furthermore, are typically pivotally mounted to the door between a first or operational position in which the ironing board extends laterally outwardly from the door and in a generally horizontal plane, and a second or storage position in which the ironing board extends vertically and closely adjacent the door.

These previously known door mounted ironing boards, however, have not proven wholly satisfactory in operation. One disadvantage of these previously known door mounted ironing boards is that they were relatively difficult to pivot between the first or operational position and the second or storage position.

A still further disadvantage of these previously known door mounted ironing boards is that such ironing board assemblies fail to include appropriate latches for locking the ironing board in both the first and second position. As such, these previously known ironing board assemblies were somewhat unstable in use.

A still further disadvantage of the previously known ironing boards is that such ironing boards were unable to accommodate doors of different heights and widths. As such, it was oftentimes necessary to purchase different ironing board assemblies for doors having different heights.

A still further disadvantage of these previously known ironing boards is that, when collapsed to their storage position, the bottom of the ironing board faced outwardly from the door. As such, it presented an unsightly appearance.

SUMMARY OF THE PRESENT INVENTION

The present invention provides an ironing board assembly for use with a door which overcomes the above-mentioned disadvantages of the previously known ironing board assemblies.

In brief, the ironing board assembly of the present invention comprises an elongated ironing board dimensioned to support clothes for ironing. The ironing board is preferably made of a flame-resistant material.

An elongated ironing board support has an upper end adapted to be attached to the top of a door so that the ironing board support extends vertically downwardly along and closely adjacent one side of the door.

One end of the ironing board is both pivotally and slidably attached to a lower end of the ironing board support so that the ironing board support is movable between a first and a second position. In its first position, the ironing board extends laterally outwardly from the door so that clothes may be ironed. Conversely, with the ironing board in its second position, the ironing board pivots vertically upwardly and closely adjacent both the ironing board support and the door for storage and so that the top of the ironing board faces outwardly from the door.

In order to enhance the rigidity of the ironing board when in its first or operational position, preferably a support leg is pivotally attached to the bottom of the ironing board adjacent its other end. The length of the support leg is adjustable in order to accommodate the ironing board at different heights. Similarly, the ironing board support is also adjustable in order to accommodate doors of different heights and different widths.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
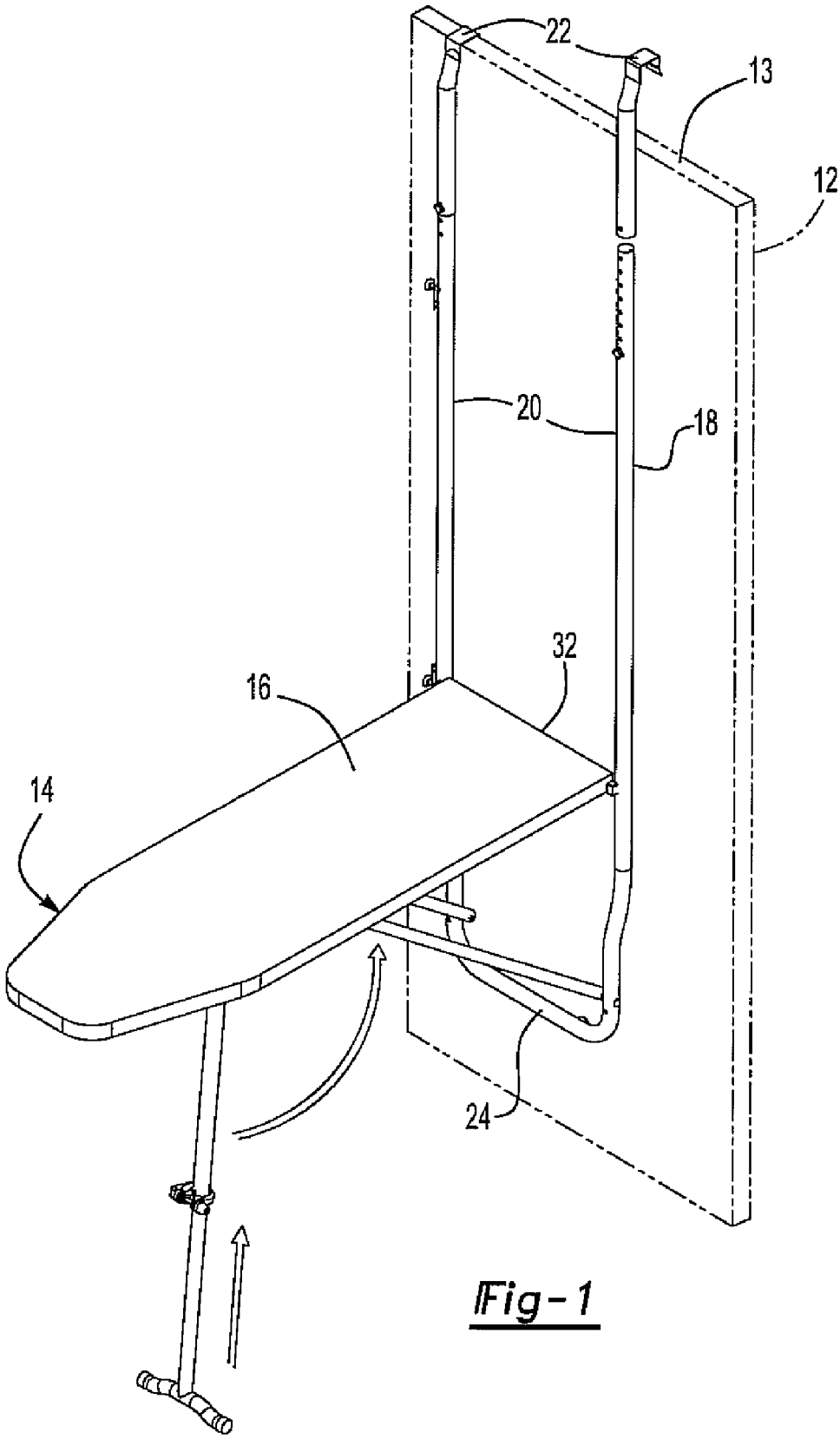
FIG. 1 is a perspective view illustrating a preferred embodiment of the present invention.

With reference first to FIGS. 1-4, a preferred embodiment of an ironing board assembly 10 according to the present invention is illustrated. The ironing board assembly 10 is intended for use with a door 12 (FIG. 1) having a top 13.

Still referring to FIGS. 1-4, the ironing board assembly 10 includes a frame 15 made of a rigid material, such as metal. The frame 15 supports and is attached to an elongated ironing board 14 having an upper planar surface 16 and which is dimensioned to support clothes or other items to be ironed. Preferably, the ironing board cover 14 is made of a fire-resistant material.

An elongated ironing board support 18 is preferably formed from two elongated rails 20 which are spaced apart and parallel to each other. A bracket 22 is secured to the upper end of each rail 20 while a cross rail 24 secures the bottom ends of the rails 20 together.

Figure 3:
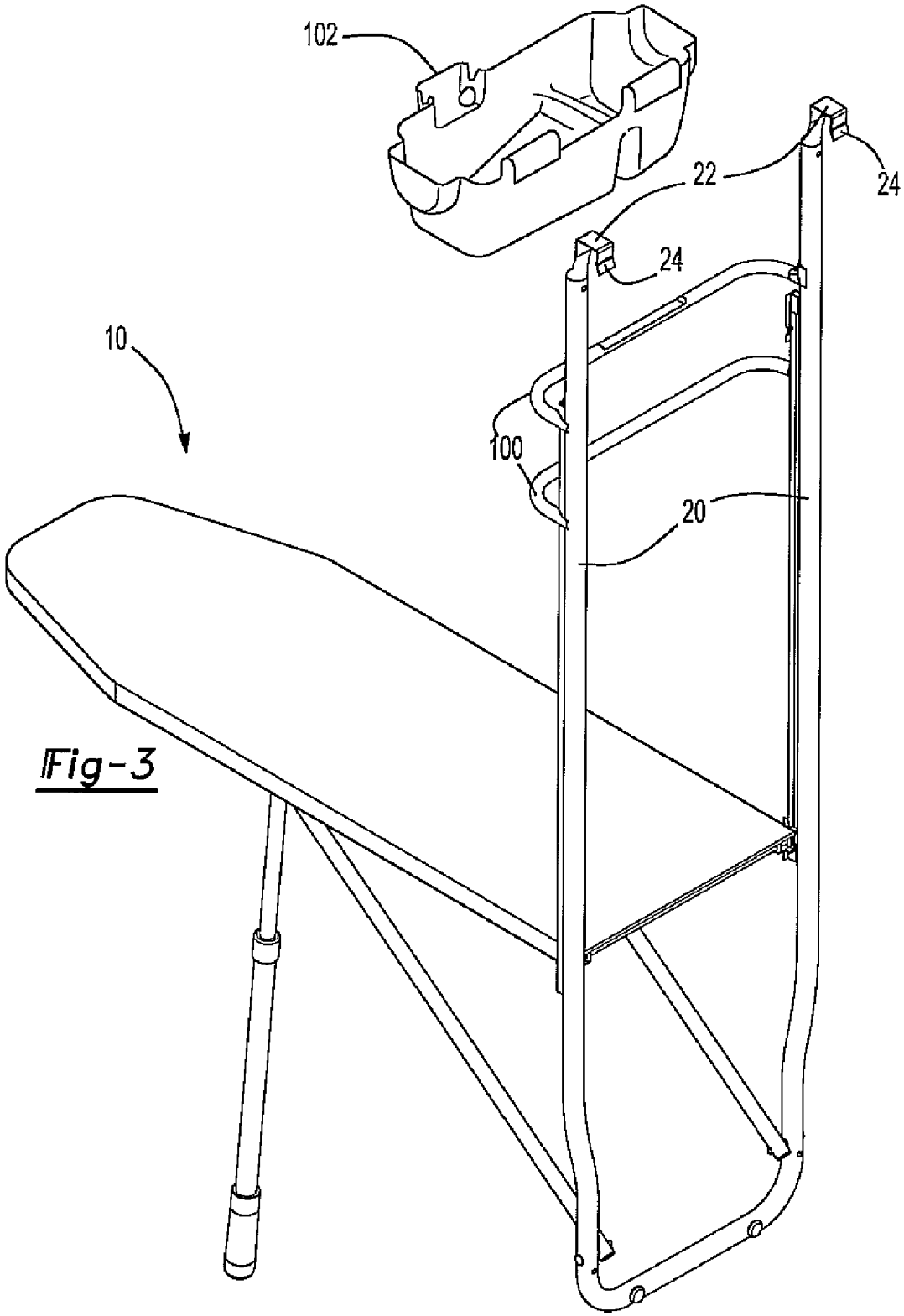
FIG. 3 is a rear elevational view illustrating a preferred embodiment of the present invention.

As best shown in FIG. 3, each bracket 22 is generally U shaped and dimensioned to fit over the top 13 of the door 12 (FIG. 1). At least one leg 24 of each bracket 22 is resilient so that, with the brackets 22 positioned over the top of the door 12 as shown in FIG. 1, the brackets 22 resiliently engage opposite sides of the door 12 adjacent its top, and hold the rails 20 generally flat against one side of the door 12 and so that the rails 20 extend generally vertically. The resilient leg 24 of the brackets 22 enable the brackets 22 to accommodate doors of different thicknesses, at least within a preset range.

Figure 4:
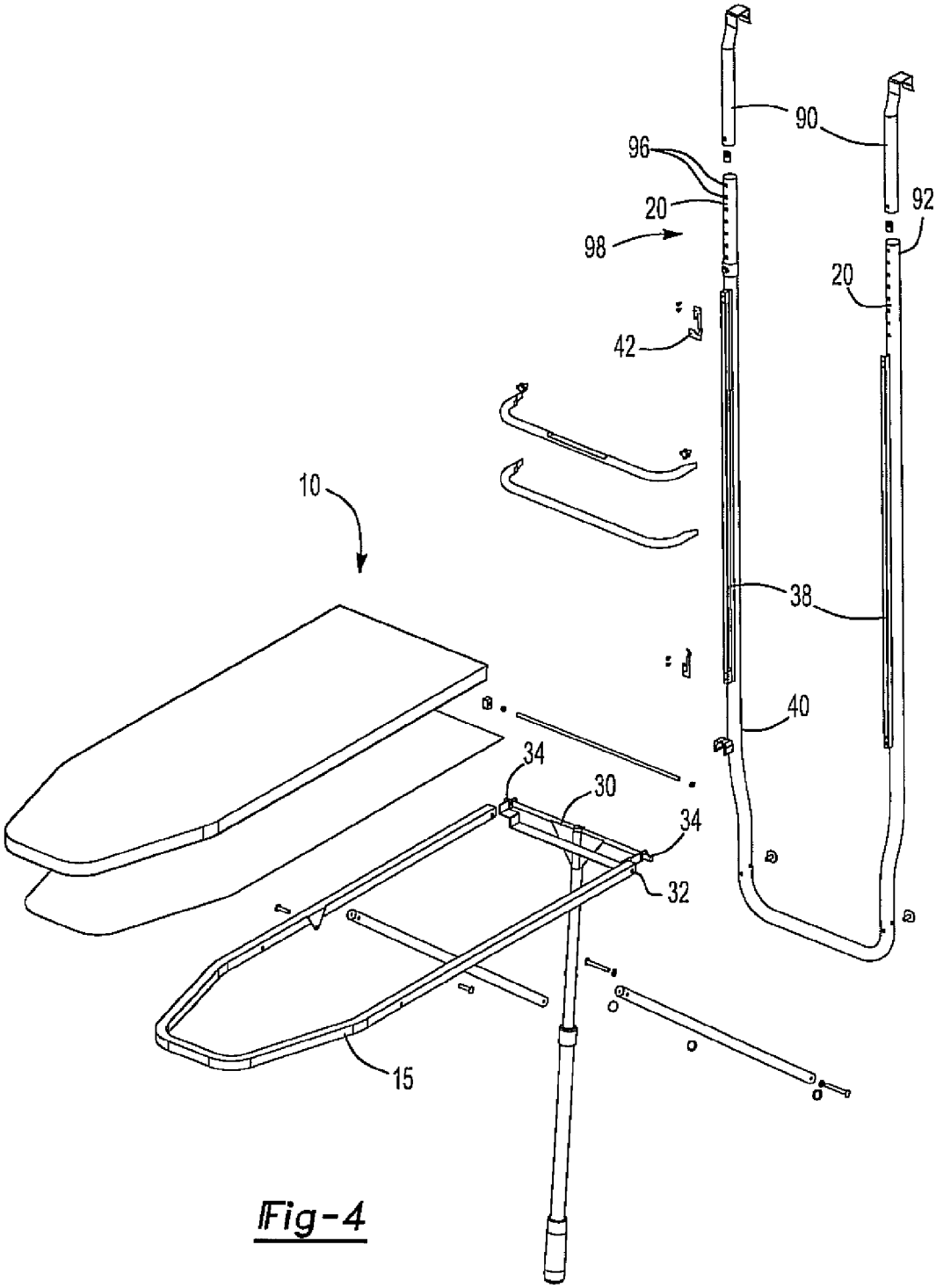
FIG. 4 is an exploded view of a preferred embodiment of the present invention.
Figure 5:
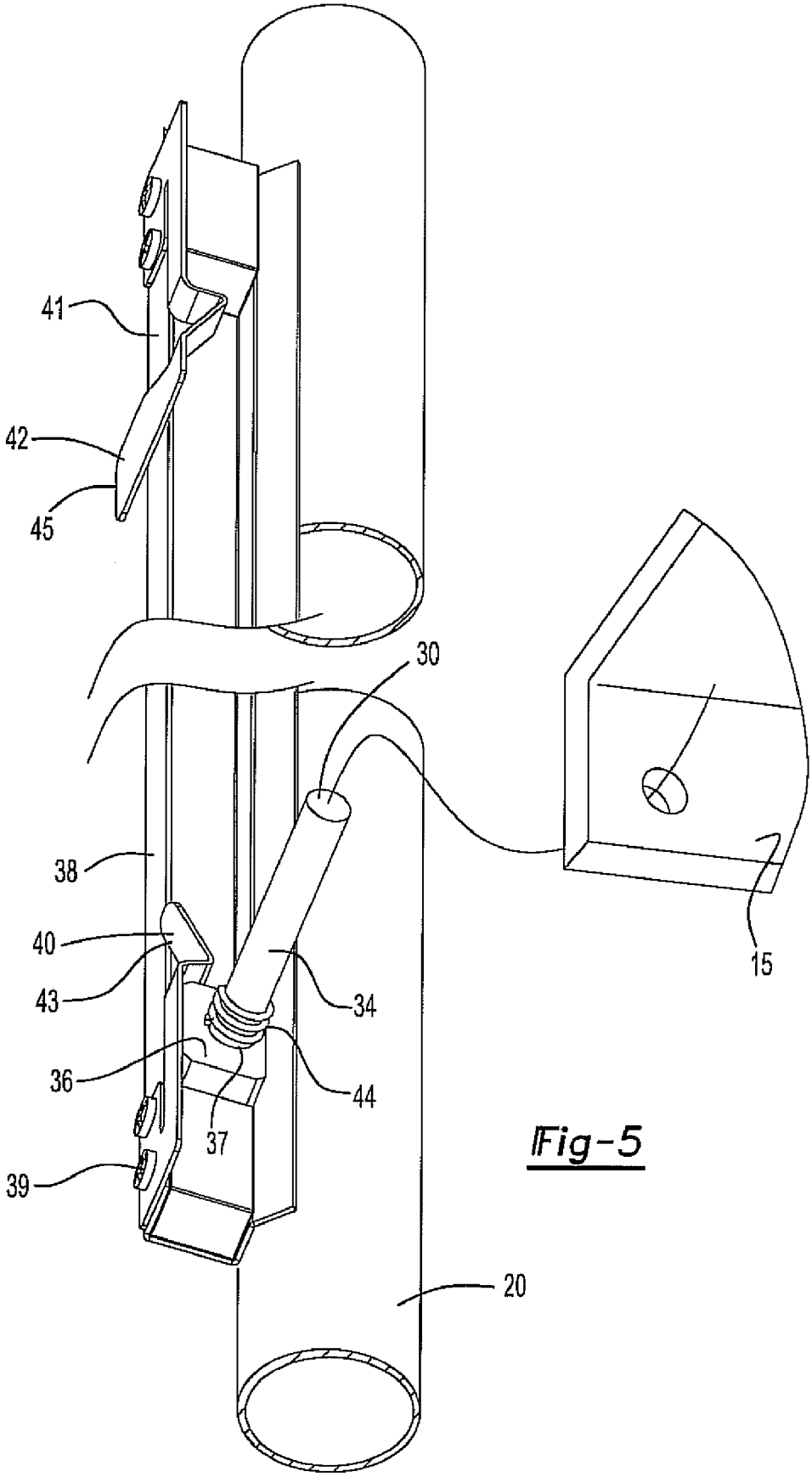
FIG. 5 is a fragmentary view illustrating a preferred embodiment for the latching system of the present invention.

With reference now to FIGS. 4 and 5 an elongated rod 30 is mounted to one end 32 of the ironing board frame 15 so that each end of the rod 30 protrudes laterally outwardly from the frame 15. These outwardly protruding ends of the rod 30 form pivot pins 34 for the ironing board 16.

As best shown in FIG. 5, an elongated channel member 38 is mounted to each rail 20 so that the channels formed by the channel members 38 face each other. A slide block 36 having a recess 37 is then slidably mounted in each channel member 38. The pivot pins 34 are positioned within the recesses 32 so that the end 32 of the ironing board 16 and slide blocks 36 move in unison with each other.

Still referring to FIG. 5, a first latch 40 selectively engages and retains the slide block 36 adjacent one end 39 of the channel member 38. Similarly, a second latch 42 also selectively engages the block 36 and retains the block 36 adjacent the opposite end 41 of the channel member 38. Each latch 40 and 42 may be manually released when desired by flexing the latch handles 43 or 45.

Still referring to FIG. 5, a compression spring 44 is disposed around each pin 34 and compressed in between the slide block 36 and the ironing board frame 15. The compression springs 44 effectively dampen any play between the ironing board frame 15 and the support 18 thus enhancing the rigidity of the ironing board 16.

Figure 2:
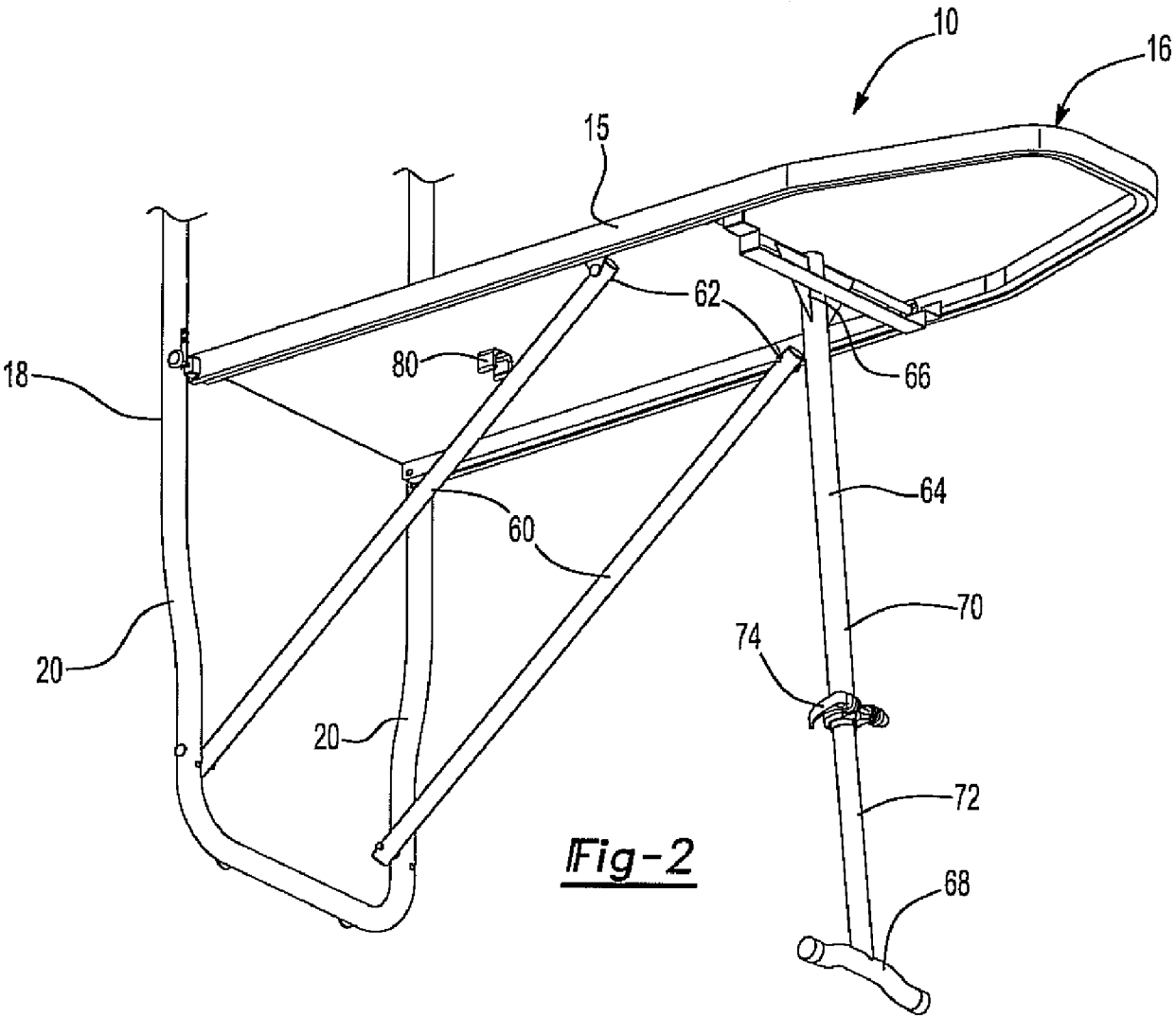
FIG. 2 is a bottom perspective view illustrating a preferred embodiment of the present invention.

As best shown in FIG. 2, a pair of bottom struts 60 are both pivotally secured at one end to the rails 20 adjacent the bottom of the ironing board support 18 and pivotally secured at their other end 62 to the ironing board frame 15. These struts 60 thus add rigidity to the frame 15 when the ironing board 16 is in its operational position for ironing.

For added rigidity, a leg 64 has its upper end 66 pivotally mounted to the ironing board frame 15. A foot 68 is secured to the bottom of the leg 64 for engaging the ground. The leg 64 thus adds additional rigidity and support to the ironing board 16.

Preferably, the leg 64 is formed from two telescoping tubes 70 and 72 which can be slid relative to each other in order to obtain the desired length of the leg 70. A cam lock 74 or a twist lock compresses the outer tube 70 against the inner tube 72 when the leg tubes 70 and 72 are moved to the desired adjusted position to thereby lock the tubes 70 and 72 together at an adjusted length.

Still referring to FIG. 2, a keeper 80 is mounted to the bottom of the ironing board 14. This keeper 80 is adapted to receive the leg 64 when the leg is pivoted upwardly and against the bottom of the ironing board 16 when storage of the ironing board 14 is desired.

Figure 6:
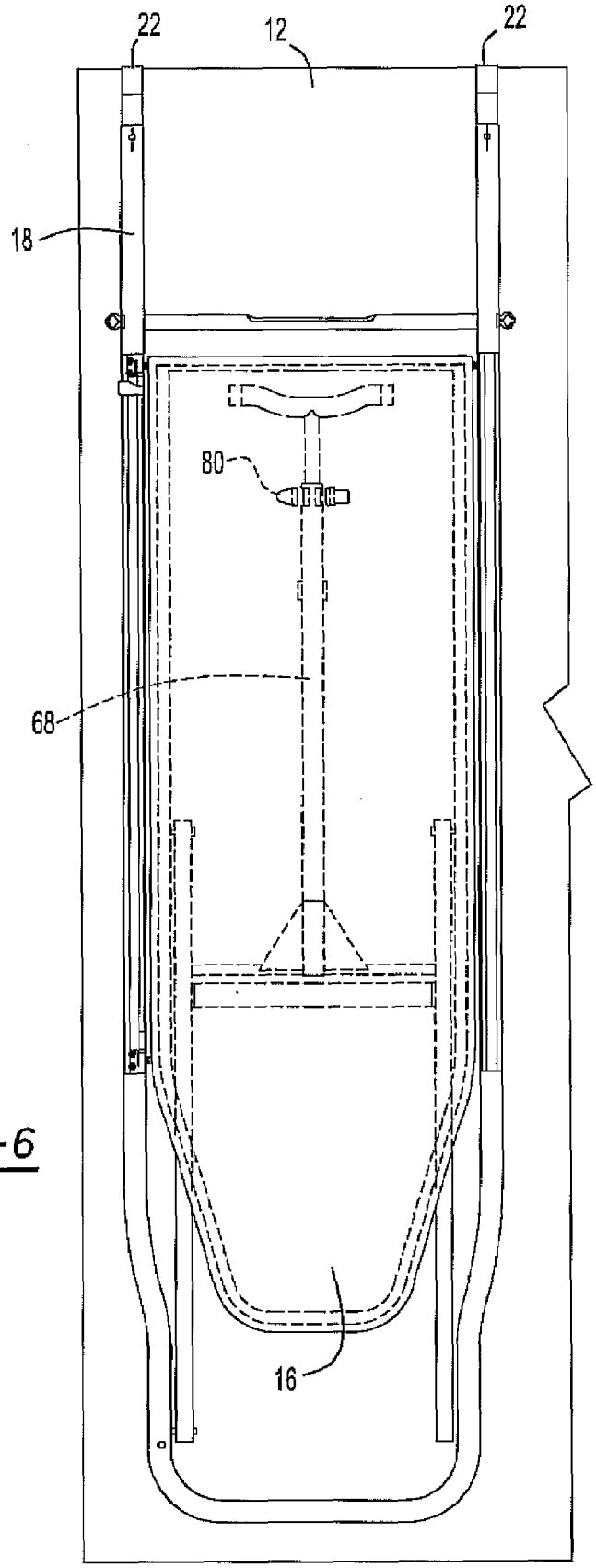
FIG. 6 is a plan view illustrating the ironing board in a storage position.
Figure 7:
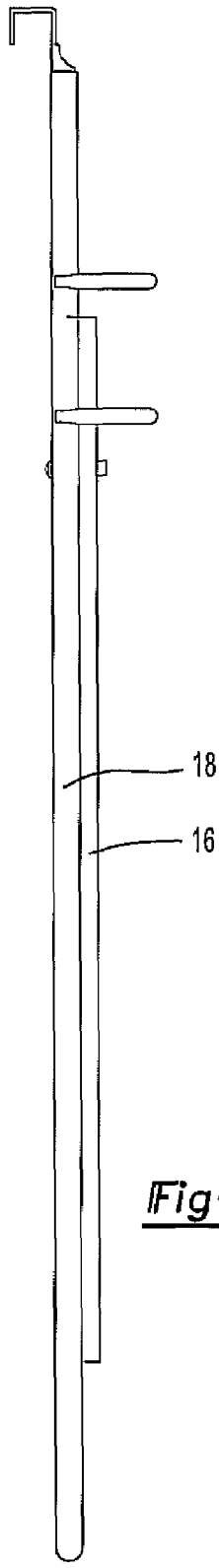
FIG. 7 is a side view illustrating the ironing board in the storage position.
Figure 8:
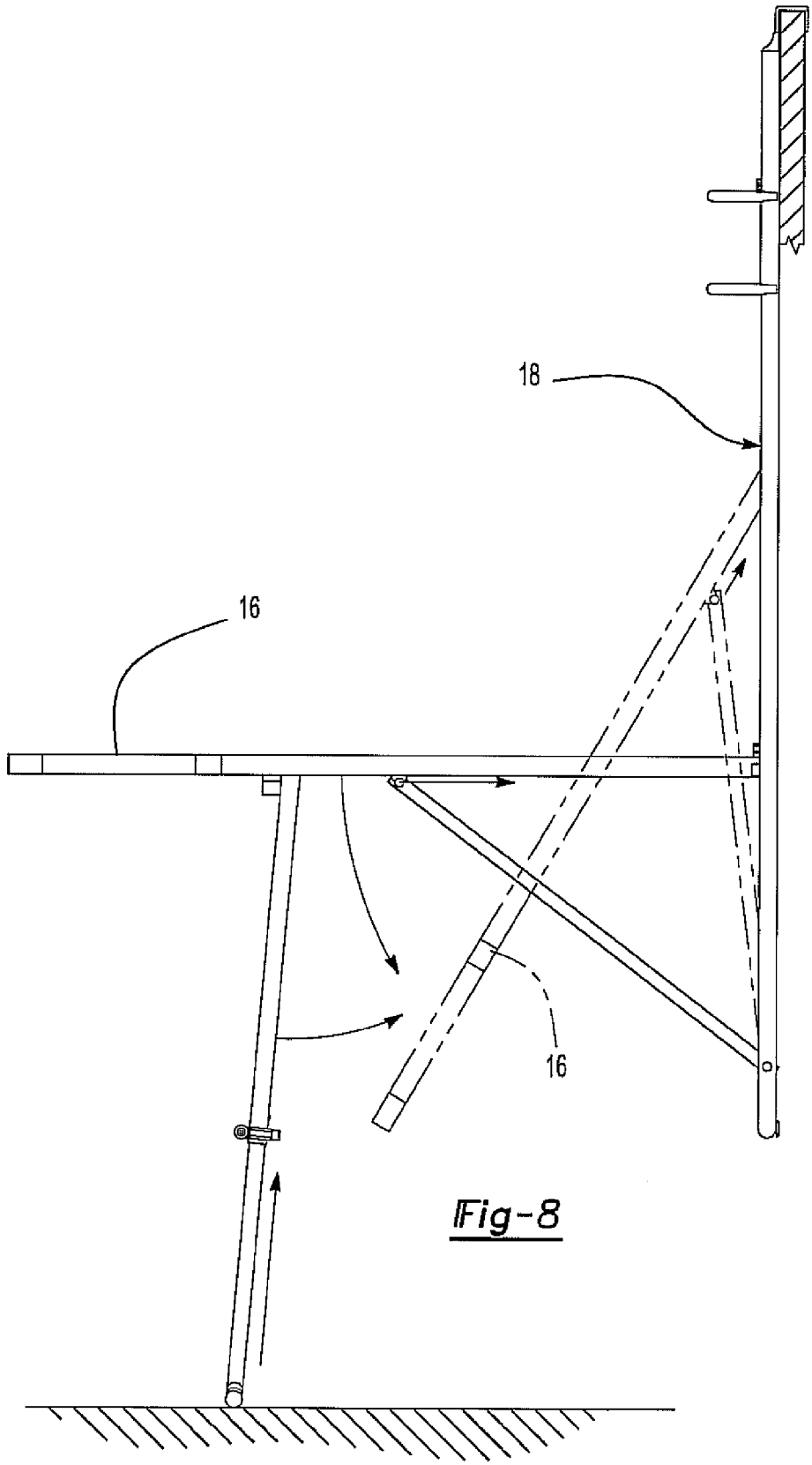
FIG. 8 is a side view illustrating the movement of the ironing board from its operational position to its storage position.

With reference now particularly to FIGS. 6-8, when use of the ironing board 14 is desired, the ironing board 14 is movable to a first or operational position, illustrated in solid line in FIG. 8, in which the ironing board 14 extends laterally outwardly from the support 18 and in a generally horizontal plane. In this position, the ironing board leg 64, if present, is pivoted downwardly so that the foot 68 engages the ground to provide additional support for the ironing board 14. Additionally, in its first or operational position, the first latch 40 engages the slide block 36 in order to firmly, but releasably, hold the ironing board 14 in its first position.

When desired, the ironing board 14 can be moved to its second or storage position as illustrated in FIGS. 7 and 8. In its storage position, the leg 68 is pivoted up against the bottom of the ironing board 14 and into the keeper 80. The slide blocks 36 are then moved to the opposite or upper end of the channel members 38 until the ironing board 16 is positioned closely adjacent the rails 20 and so that the ironing board 16 lies in a generally vertical plane with the top 16 of the ironing board facing outwardly from the door 12. At this time, the latches 42 engage the slide blocks 36 and retain the ironing board 16 in its second or storage position. Furthermore, since the top 16 of the ironing board 14 faces outwardly from the door 12, the comparatively unsightly bottom of the ironing board 14 is concealed.

With reference now particularly to FIG. 4, the effective length of each rail 20 is also preferably adjustable in order to accommodate doors 12 (FIG. 1) of different heights. Preferably, the upper end of each rail 20 includes two telescoping tubes 90 and 92 wherein at least one of the tubes include a plurality of longitudinally spaced holes. As illustrated in FIG. 4, the holes are formed in the tube 92.

At least one hole 96 is formed through the other tube 90. Thus, with the tubes 92 and 90 at a longitudinally adjusted position so that at least one of the holes 94 register with the hole 96, a pin 98 is insertable through the registering holes to lock the tubes 90 and 92 together thus altering the effective length of the rails 20 and simultaneously altering the height of the ironing board 16 when the ironing board 16 is in its first or operational position.

With reference now particularly to FIG. 3, one or more cross rails 100 extend across and are attached to the rails 20 adjacent their upper end. These cross rails 100 are preferably dimensioned to receive and support a caddy or container 102. The container 102 may be used to contain supplies used for ironing clothes and other items such as ironing sprays, the iron itself, etc.

From the foregoing, it can be seen that the present invention provides a simple and yet highly effective folding ironing board for use with a door. Having described our invention, however, many modifications thereto will become apparent to those skilled in the art to which it pertains without deviation from the spirit of the invention as defined by the scope of the appended claims.

We claim:

1. An ironing board assembly for use with a door comprising:

an elongated ironing board, an ironing board support having an upper end adapted to be attached to a top of the door so that said ironing board support extends along and closely adjacent one side of the door, means for attaching one end of said ironing board to a lower end of said ironing board support so that said ironing board is movable between a first position in which said ironing board extends horizontally outwardly from the door and a second position in which said ironing board extends vertically and closely adjacent said ironing board support and so that a top of the ironing board faces outwardly from the door, a first latch for locking said ironing board in said first position, a second latch for locking said ironing board in said second position, and a leg pivotally attached to a bottom of said ironing board adjacent a second end of said ironing board, said leg being pivotal between an operable position and a storage position, wherein with said leg in said storage position, said leg is sandwiched between said ironing board and the door so that said ironing board overlies and covers said leg.

2. The invention as defined in claim 1 and comprising means for adjusting the length of said leg.

3. The invention as defined in claim 2 wherein leg comprises a pair of telescopically slidable tubes and wherein said adjusting means comprises a clamp for locking said tubes in an adjusted position.

4. The invention as defined in claim 3 wherein said clamp comprises a cam clamp.

5. The invention as defined in claim 1 wherein said ironing board support comprises a pair of spaced apart elongated rails, each rail having a U shaped bracket attached to its upper end, said U shaped brackets dimensioned to fit over the top of the door.

6. The invention as defined in claim 5 wherein each U shaped bracket includes at least one resilient leg.

7. The invention as defined in claim 5 wherein each rail comprises a pair of telescoping tubes, at least one tube in each rail having a plurality of longitudinally spaced holes which register with a hole in the other of said tube at different longitudinally adjusted positions, a lock pin insertable through registering holes in said tubes at an adjusted position to thereby lock said tubes together at the adjusted position to thereby vary the length of said rails.

8. The invention as defined in claim 1 and comprising a pin extending laterally outwardly from said one end of said ironing board so that said pins are axially aligned, each pin being slidably received in a vertically extending slot in said ironing board support so that said pins from one end of said slot to the other end of said slot as said ironing board is pivoted from said first and to said second position.

9. The invention as defined in claim 8 and comprising a slide block slidably mounted in each said slot, each slide block having a recess which receives one of said pins.

10. The invention as defined in claim 9 and comprising a compression spring disposed around each pin.

11. The invention as defined in claim 8 wherein said first latch engages said pin when said ironing board is in said first position and said second latch engages said pin when said ironing board is in said second position.

12. The invention as defined in claim 11 wherein said first and second latches each comprise a spring lever having a portion protruding into said slot.

13. The invention as defined in claim 1 and comprising a storage bin mounted to said ironing board support.

14. The invention as defined in claim 1 comprising a storage bin removably mounted to said ironing board support.

15. The invention as defined in claim 3 wherein said clamp comprises a twist lock.

16. An ironing board assembly for use with a door comprising an elongated ironing board, an ironing board support having an upper end adapted to be attached to a top of the door so that said ironing board support extends along and closely adjacent one side of the door, means for attaching one end of said ironing board to a lower end of said ironing board support so that said ironing board is movable between a first position in which said ironing board extends horizontally outwardly from the door and a second position in which said ironing board extends vertically and closely adjacent said ironing board support and so that a top of the ironing board faces outwardly from the door, a first latch for locking said ironing board in said first position, and a second latch for locking said ironing board in said second position, wherein each rail comprises a pair of telescoping tubes, at least one tube in each rail having a plurality of longitudinally spaced holes which register with a hole in the other of said tube at different longitudinally adjusted positions, a lock pin insertable through registering holes in said tubes at an adjusted position to thereby lock said tubes together at the adjusted position to thereby vary the length of said rails.

17. An ironing board assembly for use with a door comprising:

an elongated ironing board, an ironing board support having an upper end adapted to be attached to a top of the door so that said ironing board support extends along and closely adjacent one side of the door, means for attaching one end of said ironing board to a lower end of said ironing board support so that said ironing board is movable between a first position in which said ironing board extends horizontally outwardly from the door and a second position in which said ironing board extends vertically and closely adjacent said ironing board support and so that a top of the ironing board faces outwardly from the door, a first latch for locking said ironing board in said first position, a second latch for locking said ironing board in said second position, a pin extending laterally outwardly from said one end of said ironing board so that said pins are axially aligned, each pin being slidably received in a vertically extending slot in said ironing board support so that said pins from one end of said slot to the other end of said slot as said ironing board is pivoted from said first and to said second position, and a slide block slidably mounted in each said slot, each slide block having a recess which receives one of said pins.

18. The invention as defined in claim 17 and comprising a compression spring disposed around each pin.

19. An ironing board assembly for use with a door comprising an elongated ironing board, an ironing board support having an upper end adapted to be attached to a top of the door so that said ironing board support extends along and closely adjacent one side of the door, means for attaching one end of said ironing board to a lower end of said ironing board support so that said ironing board is movable between a first position in which said ironing board extends horizontally outwardly from the door and a second position in which said ironing board extends vertically and closely adjacent said ironing board support and so that a top of the ironing board faces outwardly from the door, a first latch for locking said ironing board in said first position, a second latch for locking said ironing board in said second position, a pin extending laterally outwardly from said one end of said ironing board so that said pins are axially aligned, each pin being slidably received in a vertically extending slot in said ironing board support so that said pins from one end of said slot to the other end of said slot as said ironing board is pivoted from said first and to said second position, and wherein said first latch engages said pin when said ironing board is in said first position and said second latch engages said pin when said ironing board is in said second position.

20. The invention as defined in claim 19 wherein said first and second latches each comprise a spring lever having a portion protruding into said slot.

* * * * *